US005161627A

United States Patent [19]

Burkett

[11] Patent Number: 5,161,627

[45] Date of Patent: Nov. 10, 1992

[54] ATTACK TOOL INSERT WITH POLYCRYSTALLINE DIAMOND LAYER

[76] Inventor: Kenneth H. Burkett, 410½ N. Main St., Benton, Ill. 62812

[21] Appl. No.: 715,367

[22] Filed: Jun. 14, 1991

Related U.S. Application Data

[63] Continuation-in-part of Ser. No. 463,492, Jan. 11, 1990, abandoned.

[51] Int. Cl.[5] ..... E21B 10/56; E21C 35/18

[52] U.S. Cl. ..... 175/427; 51/295; 299/79

[58] Field of Search ..... 299/79, 86; 175/329, 175/409, 410, 427; 51/293, 295, 297

[56] References Cited

U.S. PATENT DOCUMENTS 4,604,106 8/1986 Hall et al. ..... 175/410 X
4,694,918 9/1987 Hall ..... 175/410 X
4,811,801 3/1989 Salesky et al. ..... 175/414 X

FOREIGN PATENT DOCUMENTS 1344888 10/1987 U.S.S.R. ..... 175/410
2146058 4/1985 United Kingdom ..... 299/86

OTHER PUBLICATIONS

Kennametal Brochure, "U84HDLR Bits", Jun. 1989.
VR Wesson Catalog, "Mining Bits", Jan. 1967, p. 4.

*Primary Examiner*—David J. Bagnell
*Attorney, Agent, or Firm*—Haverstock, Garrett and Roberts

[57] ABSTRACT

An insert for mining attack tools comprising a body portion having a longitudinal axis with a head end portion extending outwardly from one end thereof, the body portion having an endless side wall and being sized and shaped for insertion into a socket of an attack tool such that the head end portion extends outwardly from the attack tool for engaging a surface to be mined, the head end portion having a rounded tip end surface portion and an adjacent annular tapered surface portion extending from the endless side wall of the body portion to the tip end portion, and a layer of polycrystalline diamond compact attached to the head end portion of the insert.

11 Claims, 1 Drawing Sheet

ATTACK TOOL INSERT WITH POLYCRYSTALLINE DIAMOND LAYER

This is a continuation-in-part of Burkett U.S. patent application Ser. No. 463,492, filed Jan. 11, 1990 now abandoned.

The present invention relates generally to inserts for use with mining attack tools for the coal and mineral mining industry, and more particularly, to an insert for the tip of a mining attack tool which insert includes a head portion that has a generally conical shape with a rounded tip and a diamond outer work engaging surface which makes the insert much more durable, longer lasting and more effective than existing inserts.

BACKGROUND OF THE INVENTION

Much commercial mining today is accomplished by means of heavy machinery. This machinery often includes a large wheel or drum which is rotated while being driven into the face or surface of the coal or other mineral bearing wall being mined. Located about the periphery of the wheel or drum are a number of angularly spaced outwardly extending members called attack tools. Each of these attack tools has a hardened tip portion which engages or attacks and dislodges the coal or other mineral. The hardened tip of an attack tool can comprise an integral part of the tool, or as is more common, a replaceable insert which is soldered or brazed in place in a socket or cavity on the end of the tool. These attack tools, as they are the work engaging portion of the machine, are subject to significant wear, making tool wear an important problem for a number of reasons including its impact on the mining operation and also on the safety and economic considerations thereof.

Tool wear affects a number of operational parameters including the amount of energy consumed in mining, the product size, machine wear and tear and the main frame mass needed to advance the mining machine into the coal, as well as safety concerns such as the amount of respirable dust created by the mining process. Importantly, as the attack tools begin to wear, and more particularly, as the inserts at the tips thereof begin to wear or dull, the force required to drive the machine forward, called the normal force, can increase relatively quickly and abruptly. The normal force affects such parameters as the machine advance rate and depth of cut, which in turn affect the other parameters mentioned, making it critical to minimize the normal force in the mining operation. Dull or worn attack tools additionally tend to pulverize the coal rather than cut the coal, thereby causing higher levels of respirable coal dust which is one of the major causes of Black Lung disease.

Tool wear also results in machine downtime for changing the attack tools. It has been estimated that the downtime for the average longwall mining machine can cost as much as $200 per minute. If a mine runs three shifts a day and a longer lasting, more effective attack tool requiring fewer tool changes can save ten minutes of downtime per shift, the downtime savings would be $6,000 per day. This savings could be well over one million dollars per year in downtime alone. In addition, such operating parameters as the energy consumption of the machine and penetration rates improve and the health and wear and tear factors mentioned above also improve. Reducing the wear and tear on the mining machines additionally produces the benefit of reduced maintenance costs for the mining equipment.

Numerous mining attack tools having a variety of shapes, material compositions and tip configurations have been tried and used in the coal and mineral mining industry. One such known mining attack tool presently used in the coal industry has a steel tool body, usually of 4140 type steel or a tool steel such as S-7, the tool body having a socket in the tip thereof into which an insert, usually of tungsten carbide, is brazed in place. There are two known standard shapes for inserts used with these tools one being a pointed conical shape and the other a flat or disc-like shape. Although these shapes are standard in the industry, they both tend to wear or dull relatively quickly, resulting in the problems and reduced effectiveness discussed above.

In recent years some thought has been given to hardening inserts for the tips of mining attack tools by the use of diamond compacts. One such type of diamond compact is disclosed in Hall et al U.S. Pat. No. 4,604,106. This composite polycrystalline diamond (PCD) compact was disclosed for use in cutting, machining, drilling and like operations. Rock bits (which operate essentially in a rapid up-and-down motion) were also contemplated in the Hall invention. A 1984 patent issued to Campbell, U.S. Pat. No. 4,481,016, also discloses a method of making inserts suitable for attack tools or drill bits. This method describes fragmenting an abrasive compact into a plurality of discreet, non-segmental fragments. The abrasive compact in Campbell could be cubic boron nitride or diamond particle. The particular geometric shapes disclosed in the prior art include a rounded tip with steep sides such as disclosed in Hall, and a pointed conical tip as disclosed in Campbell. However, testing results show that both the rounded tip and the steep sides of Hall and the pointed conical tip of Campbell suffer from a number of deficiencies and do not substantially reduce the wear of a mining attack tool.

SUMMARY OF THE INVENTION

The present invention overcomes many of the disadvantages and shortcomings associated with known constructions and teaches the construction and operation of an insert for mining attack tools, the present insert including an annular tapered or substantially conical shaped head portion having a curved or rounded tip with a diamond work engaging surface on the head end portion which surface is much longer lasting and more effective and economical than existing inserts. The present insert also includes a body portion adapted for insertion into the socket or cavity of an attack tool body. The body portion of the insert preferably has a standard size and shape for use with conventional attack tools and can be attached in position in the socket of the attack tool using conventional soldering and brazing techniques or by other methods such as adhesively or mechanically attaching it. The present insert is preferably formed as a unitary member of tungsten carbide or other material which Provides suitable hardness and thermal expansion characteristics, and which provides a suitable substrate for receiving and bonding a layer or layers of diamond and carbide particles thereto.

The head portion of the preferred insert has a shape including a frusto-conical base portion extending adjacent to the body portion of the insert and a rounded tip or end portion on the end thereof opposite the body portion. The slope or taper of the conical surface combined with the rounded tip portion are important features of the present invention. The opposing sloping surfaces of the conical base portion are preferably related at an angle ranging from about 70 to about 90 degrees for coal mining applications. It has been found that an angle in this range in combination with the other important features of the present invention provide an unexpected and significant increase in durability, longevity and effectiveness when compared with known inserts. The tip portion has a curved or rounded shape making it flattened or blunted and not pointed, thereby substantially reducing the possibility for cracks and fractures in the diamond work engaging surface. The rounded tip portion preferably has the shape of a segment of a spherical surface having its peripheral edge intersecting the conical surface substantially tangentially relative to the angle formed by the projections of the opposite sides of the conical surface.

The diamond materials of the outer work engaging surface of the head portion is preferably a composite polycrystalline diamond compact bonded in a conventional manner to the end surface of the tungsten carbide insert. The preferred PCD compact is a composite including carbide particles or pieces interspersed with diamond crystals which is formed by heat and pressure, such as taught in Hall et al U.S. Pat. No. 4,604,106. The preferred PCD compact has a percent volume or concentration of carbide which is greater adjacent to and closer to the tungsten carbide body or other substrate and lesser toward the outer working surface, with the outer work engaging surface preferably comprised substantially entirely of polycrystalline diamond particles. The PCD compact is an important feature of the present invention as it provides a super hard working or cutting surface which is particularly wear resistant.

It is therefore an object of the present invention to provide a diamond-tipped insert for an attack tool which substantially increases the tools life.

It is another object of the present invention to provide an attack tool with a diamond-tipped insert which is long lasting and reduces respirable dust, machine wear and tear, and other deleterious effects such as are produced by known attack tools which wear more rapidly.

It is another object of the present invention to disclose an attack tool having a diamond-tipped insert which produces dramatically improved wear and operating efficiency.

It is another object of the present invention to provide an improved insert for use on mining attack tools which has a rounded conical shaped head end portion having a PCD compact on the work engaging surfaces thereof.

It is another object of the present invention to provide a longer lasting insert for use on mining attack tools which is economical to manufacture and use.

Still another object is to teach the construction of a cutting insert for an attack tool used in mining operations having a head end portion including a rounded end surface which extends smoothly into an adjacent conical end surface, which end surfaces are coated with a layer or layers of hard work engaging material such as polycrystalline diamond in a compact.

These and other objects and advantages of the present invention will become apparent to those skilled in the art after considering the following detailed specification in conjunction with the accompanying drawings wherein;

DETAILED DESCRIPTION OF THE PREFERRED EMBODIMENTS

Figure 1:
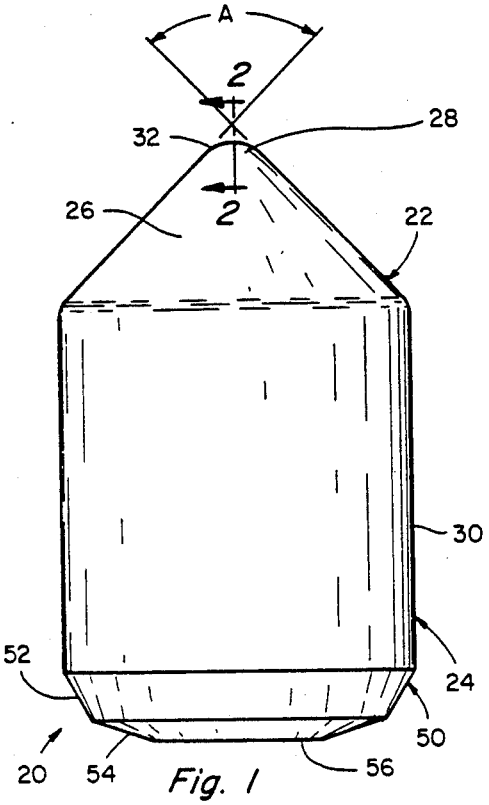
FIG. 1 is an enlarged, side elevational view of an insert for an attack tool constructed according to the teachings of the present invention, the insert including a head end portion having a rounded tip portion and an adjacent conical shaped portion all of which are coated with a layer or layers of a polycrystalline diamond compact.

Referring to the drawings more particularly by reference numbers wherein like numerals refer to like parts, number 20 in FIG. 1 identifies a mining attack tool insert constructed according to the teachings of the present invention. The insert 20 includes a head end portion 22 which extends outwardly or protrudes forwardly in the direction of engagement with a work surface from an attack tool for engaging a surface to be mined and a body portion 24 which is insertable into a cavity or socket of an attack tool as will be described. The head end portion 22 of the present insert 20 has an annular tapered or frusto-conical shaped surface portion 26 terminating in a curved or rounded tip end portion 28 all of which is coated with a layer of a diamond, preferably a composite polycrystalline diamond compact, which forms the work engaging surface of the insert 20. The rounded-conical shape of the head end portion 22 and the PCD compact provide substantially improved wear characteristics and longevity compared to conventional inserts having more pointed and less rounded or hemispherical shaped head end portions. The present insert 20 preferably is of unitary construction and is formed of a material such as tungsten carbide or other material which provides a suitable substrate for attaching the layer or layers of the composite polycrystalline diamond compact to the head end portion 22 of the insert. The body portion 24 of the insert 20 is preferably conventionally sized and shaped for insertion into and attachment to a standard attack tool cavity.

The head end portion 22 of the insert 20 is formed by an annular tapered surface portion 26 which is preferably frusto-conical shaped and extends from adjacent to the side wall 30 of the body 24 and a curved or rounded tip end portion 28 opposite the body 24. Importantly, the frusto-conical surface 26 terminates at the periphery of the round tip end portion 28 such that the tip 28 can have the desired rounded shape, preferably a portion or segment of a spherical surface, as discussed below. The frusto-conical shaped portion 26 is centered about the longitudinal axis of the head end portion 22 and the opposite sides thereof taper or slope convergingly toward the tip end portion 28. The conical surface 26 subtends an angle denoted as angle A in FIG. 1 which is measured between the opposing convergingly related sides of the surface 26. The value of angle A will vary depending on the nature of a particular mining application. For example, a range from 70 to 90 degrees has been found by the inventor to be the most suitable range for the angle A when the insert is used for coal mining applications. For mining relatively soft coal, an angle A nearer 70 degrees, such as 75 degrees, has been found to be preferred. For mining harder coal, a gentler, broader angle A nearer 90 degrees has been found to be more suitable.

Figure 2:
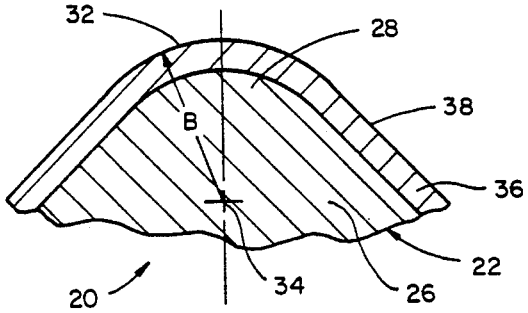
FIG. 2 is an enlarged, fragmentary cross-sectional view of the tip of the head end portion of the insert of FIG. 1 taken along lines 2—2 therein and showing a layer of PCD compact

The tip end portion 28 has an outer tip surface 32 which has a convex, curved shape, as shown in FIG. 2. The curved outer tip surface 32, as stated, is preferably a round or spherical segment with a center at point 34 located on the longitudinal axis of the insert and a radius denoted as radius B. The tip end portion 28 can alternatively have its outer surface 32 of other curved shapes including segments of an ellipsoid, hyperboloid, paraboloid and other curved forms. Regardless of which shape is selected, the peripheral edge of the surface 32 should be smoothly or substantially tangentially related to the conical surface 26 such that the tip end portion 28 forms a rounded end and smooth extension of the frusto-conical shaped surface 26.

Figure 3:
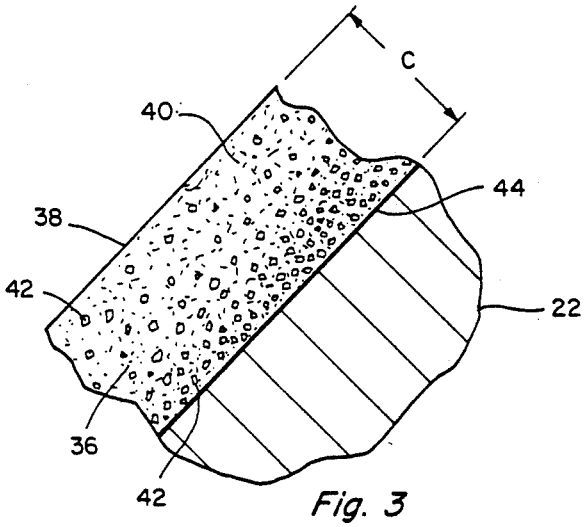
FIG. 3 is a further enlarged view of a portion of the tips shown in FIG. 2 showing in even greater detail the preferred form of the PCD compact layer.

The head end portion 22 includes a polycrystalline diamond compact 36 which forms the outer work engaging or working surface 38 of the insert 20. The PCD compact 36 preferably comprises at least one layer of a composite of polycrystalline diamond 40 and carbide particles 42 bonded to the head end surface 44 of the tungsten carbide substrate of the insert 20, as shown in FIG. 3, using heat and pressure in a manner such as taught by Hall U.S. Pat. No. 4,604,106. The polycrystalline diamond 40 and carbide particles 42 are interspersed among one another and the PCD compact 36 can be comprised of relatively discrete layers having desired percentages of polycrystalline diamond 40 and carbide particles 42, or alternatively, can comprise a single layer of the composite material wherein the concentration of the polycrystalline diamond is highest at the working surface 38, the working surface 38 being preferably substantially 100 percent polycrystalline diamond, and then gradually decreasing in percent volume toward the substrate surface 44, as more fully explained in U.S. Pat. No. 4,604,106. The PCD compact 36 has a thickness denoted as the distance C which is measured from the substrate surface 44 to the outer work engaging surface 38. The thickness C is preferably in a range from about 0.035 to about 0.045 inches which has been found to be the most suitable thickness for coal mining applications, but this range may vary to some extent for particular applications.

Figure 4:
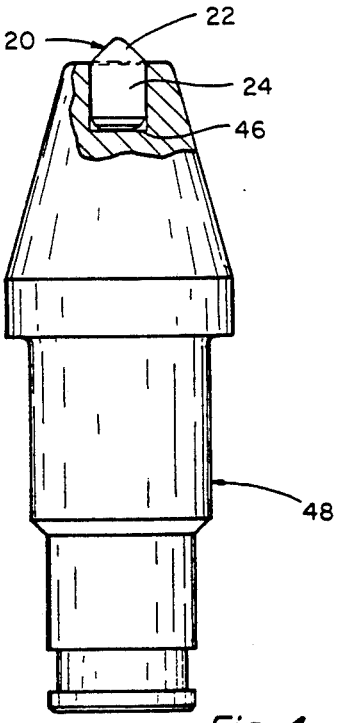
FIG. 4 is a side elevational view of a typical attack tool, the work engaging end portion thereof being shown in partial cross-section to reveal an insert positioned in a socket in the end thereof.
Figure 5:
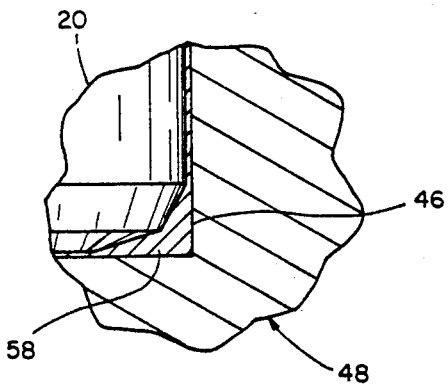
FIG. 5 is an enlarged, fragmentary cross-sectional view of a portion of the attack tool and insert of FIG. 4, showing one portion of the base of the insert and the socket therefor with the brazed solder attachment therebetween.

The insert body portion 24 is insertable into a cavity or socket 46 formed in the work engaging end of an attack tool 48 (FIG. 4) which may be of conventional shape and size for use with the machine intended. Referring again to FIG. 1, the preferred body portion 24 has an endless side wall 30 having a conventional cylindrical shape and a central longitudinal axis which is coaxial with the axis of the head end portion 22. The outer cylindrical surface 30 extends from the head end portion 22 to the rear end portion 50 which is shown formed by one or more tapered portions 52 and 54 and flat base surface 56. The body 24 is insertable into the socket or cavity 46 of an attack tool 48 in the conventional manner with the head end portion 22 extending outwardly or protruding from the work engaging end of the attack tool 48, as shown in FIG. 4. The insert 20 is attached to the tool 48 using a solder or brazing material 58 in the usual manner, as shown in FIG. 5. The shape of the body portion 24 of the insert 20 and the attack tool body 48 and cavity 46 are not part of this invention.

Thus, there has been shown and described several embodiments of an attack tool insert construction which fulfills all of the objects and advantages sought therefor. Many changes, modifications, variations, and other uses and applications of the present constructions will, however, become apparent to those skilled in the art after considering this specification and the accompanying drawings. All such changes, modifications, variations, and other uses and applications which do not depart from the spirit and scope of the invention are deemed to be covered by the invention which is limited only by the claims which follow.

What is claimed is:

1. An insert for installing in an attack tool for a mining machine comprising:

a body portion having a longitudinal axis with a head end portion extending outwardly from one end thereof, said body portion having an endless side wall and being sized and shaped for insertion into a socket in a work engaging end portion of the attack tool such that said head portion extends outwardly from the attack tool for engaging a surface to be mined, said head end portion having a curved tip end surface portion and an adjacent annular tapered surface portion extending from the endless side wall of said body portion to said tip end portion, and a layer of polycrystalline diamond compact attached to the head end portion of the insert.

2. The insert of claim 1 wherein said annular tapered surface is frusto-conical in shape and the opposite sides thereof subtend an angle between about 70 to 90 degrees.

3. The insert of claim 1 wherein said curved tip end surface has the shape of a spherical segment.

4. The insert of claim 1 wherein said polycrystalline diamond compact comprises a composite having at least one layer of interspersed polycrystalline diamond and carbide.

5. The insert of claim 1 wherein said body and head end portions are formed of tungsten carbide.

6. The insert of claim 1 wherein the annular tapered surface adjoins the curved tip end surface along an edge of substantial tangency.

7. The insert of claim 1 wherein the endless side wall of said body portion is cylindrical.

8. An insert for installing in a work engaging end portion of a mining attack tool the opposite end of which amounts on a mining machine, the insert comprising:

an insert body portion adapted for insertion into a socket formed in the work engaging end portion of the mining attack tool, said insert body portion having a side wall portion and a head end portion adjacent to one end of said insert body portion which end portion extends outwardly from the work engaging end portion of the mining attack tool for engaging a surface to be mined, the head end portion having a rounded tip end portion and an adjacent frusto-conical shaped surface extending between the side wall of the body portion to the tip end portion, said frusto-conical shaped surface extending convergingly toward said tip end portion, and a layer of polycrystalline diamond formed on the head end portion.

9. The insert of claim 8 wherein the layer of polycrystalline diamond includes a portion adjacent to the head end portion of the body formed of a composite of polycrystalline diamond interspersed with particles of a carbide substance and an outer work engaging portion formed primarily of polycrystalline diamond.

10. In an insert for installing in a socket on a work engaging end of a attack tool having an opposite end for rotatably mounting on a mining machine, the insert having a body portion for installing in the socket and a head end portion which protrudes from the socket for engaging a surface to be mined and which head portion has a layer of polycrystalline diamond on the outer surface thereof, an improvement comprising a shape for the head end portion of the insert characterized by a frusto-conical outer surface portion that subtends an angle between about 70 to 90 degrees and a rounded tip end portion which forms a continuation of the frusto-conical outer surface portion.

11. An attack tool for a mining machine comprising a tool body having a work engaging tool end portion with a socket formed therein and an opposite end portion for installing in a mining machine, and an insert for installing in the socket including a body portion having opposed ends and an endless side wall extending therebetween, one of the opposed ends being a work engaging insert end, said body portion being sized and shaped to be positioned in the socket in the tool body with the work engaging insert end exposed and protruding outwardly from the tool body, the work engaging insert end being defined by an annular tapered wall and a rounded central end wall portion forming an extension of the tapered wall, and a layer of a substance including polycrystalline diamond attached to the insert body and extending over the work engaging insert end.

* * * * *

UNITED STATES PATENT AND TRADEMARK OFFICE

CERTIFICATE OF CORRECTION

PATENT NO. : 5,161,627

DATED : November 10, 1992

INVENTOR(S) : Kenneth Burkett

It is certified that error appears in the above—identified patent and that said Letters Patent is hereby corrected as shown below:

Column 2, line 60, "Provides" should be --provides--.

Column 4, line 13, after compact, insert --attached thereto;--.

Column 6, line 58, "amounts" should be --mounts--.

Signed and Sealed this

Twenty-eighth Day of September, 1993

Bruce Lehman

*Attest:*

BRUCE LEHMAN

*Attesting Officer*

*Commissioner of Patents and Trademarks*